US007439004B2

(12) United States Patent
Malachowski et al.

(10) Patent No.: US 7,439,004 B2
(45) Date of Patent: Oct. 21, 2008

(54) METHODS FOR WASHING AND DEWATERING TONER

(75) Inventors: Steven M Malachowski, East Rochester, NY (US); Chieh-Min Cheng, Rochester, NY (US); David Kurceba, Hamilton (CA); Tie Hwee Ng, Mississauga (CA); Abdisamed Sheik-Qasim, Etobicoke (CA); Melanie Davis, Hamilton (CA)

(73) Assignee: Xerox Corporation, Norwalk, CT (US)

( * ) Notice: Subject to any disclaimer, the term of this patent is extended or adjusted under 35 U.S.C. 154(b) by 750 days.

(21) Appl. No.: 10/999,020

(22) Filed: Nov. 30, 2004

(65) Prior Publication Data

US 2006/0115764 A1 Jun. 1, 2006

(51) Int. Cl.
*G03G 9/08* (2006.01)

(52) U.S. Cl. ..... 430/137.1; 430/137.14

(58) Field of Classification Search ..... 430/137.1, 430/137, 14, 137.17, 137.19
See application file for complete search history.

(56) References Cited

U.S. PATENT DOCUMENTS

| | | | | |
|---|---|---|---|---|
| 4,661,439 | A * | 4/1987 | Ruskin | 430/449 |
| 6,099,725 | A * | 8/2000 | Silverstein et al. | 210/227 |
| 6,294,606 | B1 * | 9/2001 | Chen et al. | 524/501 |
| 6,787,492 | B2 * | 9/2004 | Oksanen et al. | 442/268 |
| 2004/0166430 | A1 * | 8/2004 | Sacripante et al. | 430/137.1 |

OTHER PUBLICATIONS

Neufeldt, V., et al., ed., Webster's New World Dictionary, Third College Edition, Simon & Schuster, Inc., NY (1988), pp. 1265 and 1277.*

* cited by examiner

*Primary Examiner*—Janis L Dote
(74) *Attorney, Agent, or Firm*—Oliff & Berridge, PLC

(57) ABSTRACT

Methods include washing and de-watering toner particles using a horizontal filter press.

9 Claims, 8 Drawing Sheets

METHODS FOR WASHING AND DEWATERING TONER

BACKGROUND OF THE INVENTION

1. Field of Invention

Methods include washing and de-watering toner particles using a horizontal filter press.

2. Description of Related Art

Various methods for production of toner result in formation of a slurry including toner particles dispersed in a solvent. At such point in production, it is necessary to de-water the slurry and/or or wash toner particles to obtain a usable toner. Various methods of de-watering and washing toner particles are known, including, for example, using vertical plate presses and centrifugation. However, these and other known methods are deficient, at least because the methods are not scalable to commercial manufacture, filter media are subjected to blinding, a toner cake cannot be quickly and easily discharged and resulting toner particles are degraded in morphology. These failings can present inefficiencies in manufacture, and can result in toner particles of deficient quality.

Accordingly, there exists a need for a method for de-watering and washing toner particles that does not present the above mentioned shortcomings.

SUMMARY OF THE INVENTION

In producing toner particles, for example by an emulsion-aggregation chemical toner process, there is a need to wash and de-water the toner particles (e.g., particles having a diameter of from about 2 to about 8 microns) to a moisture content of from about 18 to about 41 percent, while maintaining particle integrity. It has been discovered that a horizontal filter press can be used to wash and de-water toner particles in a manner that provides toner products having useful moisture content and particle integrity, in smaller, and thus more efficient, time periods.

In various exemplary embodiments, methods according to the present invention include de-watering and/or washing toner particles using a horizontal filter press. In various exemplary embodiments, duration and pressure with which materials are introduced to a horizontal filter press and pressure that is applied to those materials is controlled to produce toner having desirable purity, porosity, resistivity and particle structure.

In various exemplary embodiments, methods for de-watering a toner according to the present invention include pumping a toner slurry into a filter plate of a horizontal filter press; applying pressure to the toner slurry with a diaphragm to drive a liquid through a filter cloth and form a toner cake; releasing pressure from the toner cake; pumping air into the filter plate to dry the toner cake; and driving the filter cloth through the horizontal filter press in a serpentine manner to remove the toner cake.

In various exemplary embodiments, methods for washing and de-watering a toner according to the present invention include pumping a toner slurry into a filter plate of a horizontal filter press; applying pressure to the toner slurry with a diaphragm to drive a liquid through a filter cloth and form a toner cake; pumping a washing liquid through the toner cake and the filter cloth; releasing pressure from the toner cake; pumping air into the filter plate to dry the toner cake; and driving the filter cloth through the horizontal filter press in a serpentine manner to remove the toner cake.

In various exemplary embodiments, methods for washing and de-watering a toner according to the present invention include pumping a first toner slurry into a filter plate of a horizontal filter press; applying pressure to the toner slurry with a diaphragm to drive a first liquid through a filter cloth and form a first toner cake; releasing pressure from the first toner cake; pumping a washing liquid into the filter plate to form a second toner slurry; applying pressure to the second toner slurry with the diaphragm to drive a second liquid through the filter cloth and form a second toner cake; releasing pressure from the second toner cake; pumping air into the filter plate to dry the second toner cake; and driving the filter cloth through the horizontal filter press in a serpentine manner to remove the second toner cake.

In various exemplary embodiments, methods for washing and de-watering a toner according to the present invention include pumping a first toner slurry into a filter plate of a horizontal filter press; applying pressure to the toner slurry with a diaphragm to drive a first liquid through a filter cloth and form a first toner cake; releasing pressure from the first toner cake; pumping a first washing liquid into the filter plate to form a second toner slurry; applying pressure to the second toner slurry with the diaphragm to drive a second liquid through the filter cloth, recover the second liquid and form a second toner cake; releasing pressure from the second toner cake; determining an impurity content of the second liquid; comparing the impurity content of the second liquid with a target impurity content; pumping a second washing liquid into the filter plate to form a third toner slurry; applying pressure to the third toner slurry with the diaphragm to drive a third liquid through the filter cloth and form a third toner cake; releasing pressure from the third toner cake; pumping air into the filter plate to dry the third toner cake; and driving the filter cloth through the horizontal filter press in a serpentine manner to remove the third toner cake.

For a better understanding of the invention as well as other aspects and further features thereof, reference is made to the following drawings and descriptions.

BRIEF DESCRIPTION OF THE DRAWINGS

Various exemplary embodiments of the invention will be described in detail with reference to the following figures, wherein.

DETAILED DESCRIPTION OF EXEMPLARY EMBODIMENTS

Figure 1:
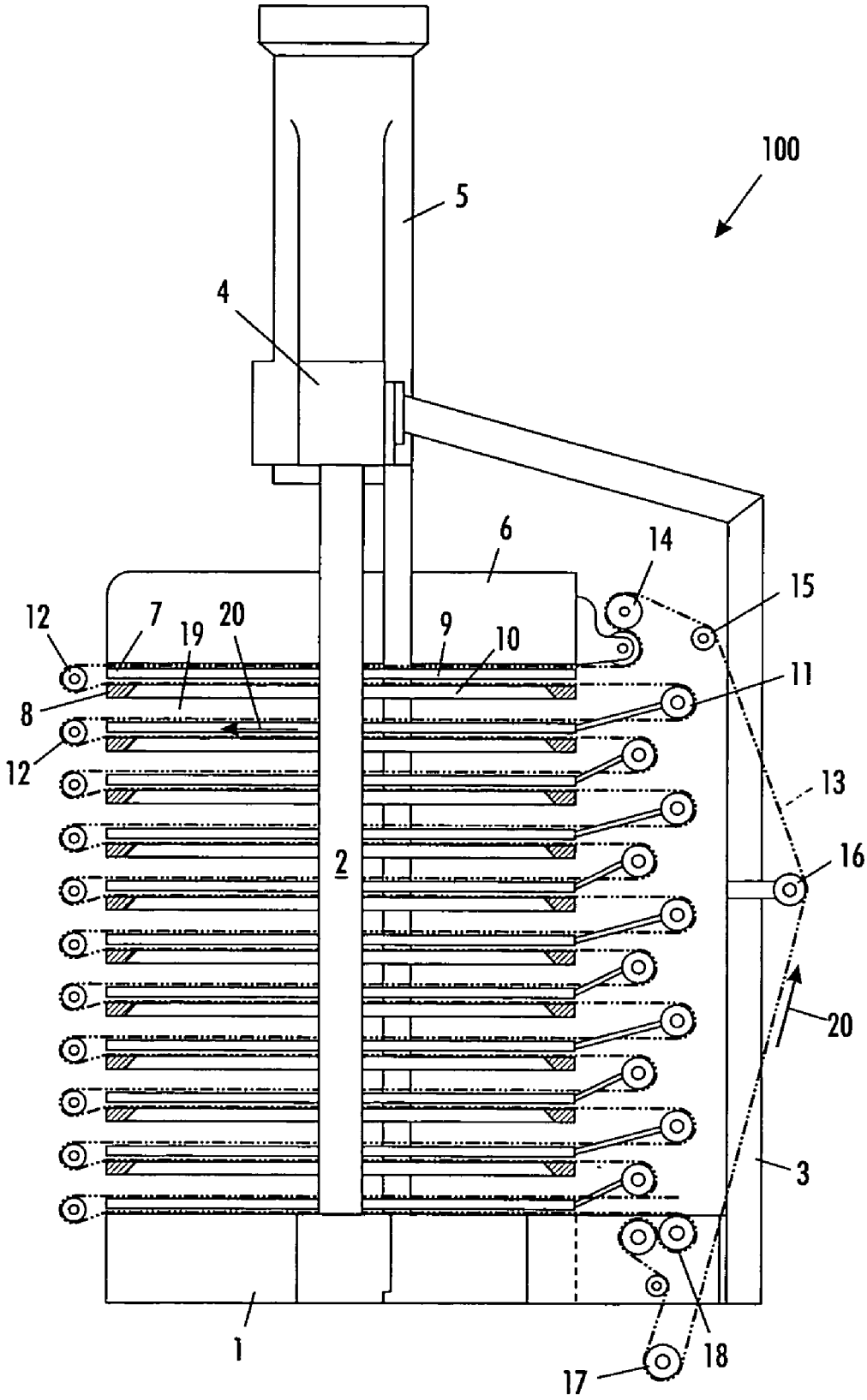
FIG. 1 is a plan view of a known horizontal filter press.
Figure 2A:
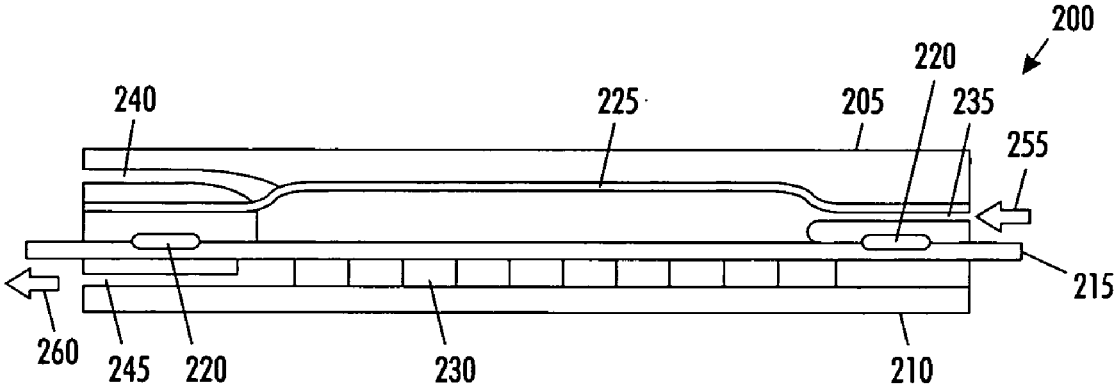
FIGS. 2(*a*) to 2(*e*) are schematic cross-sections of filter plates used in a horizontal filter press, showing performance of an exemplary method according to the present invention.
Figure 2B:
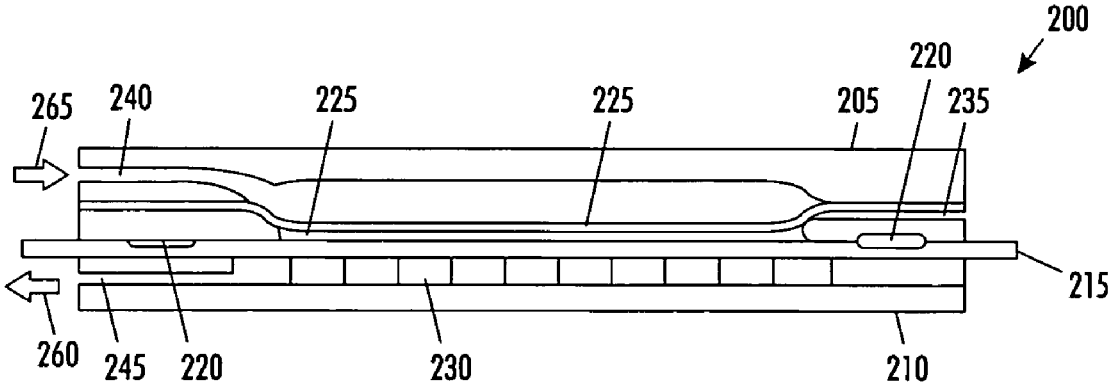
Figure 2C:
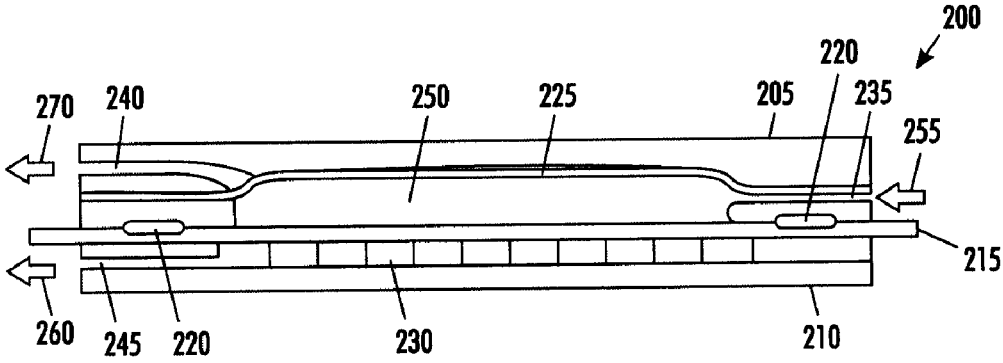
Figure 2D:
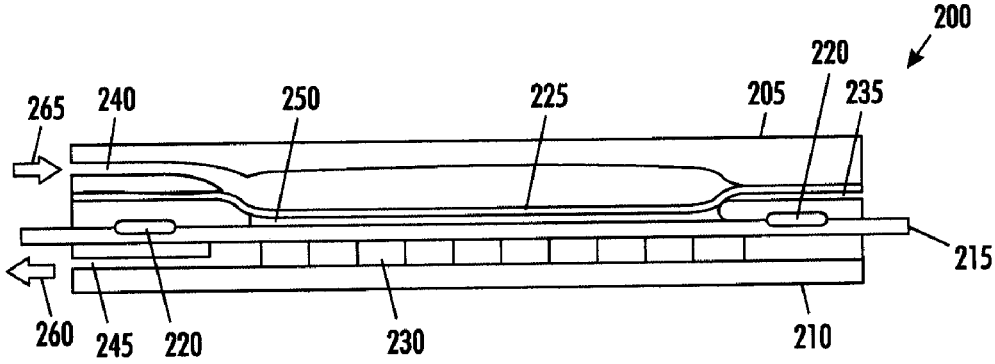
Figure 2E:
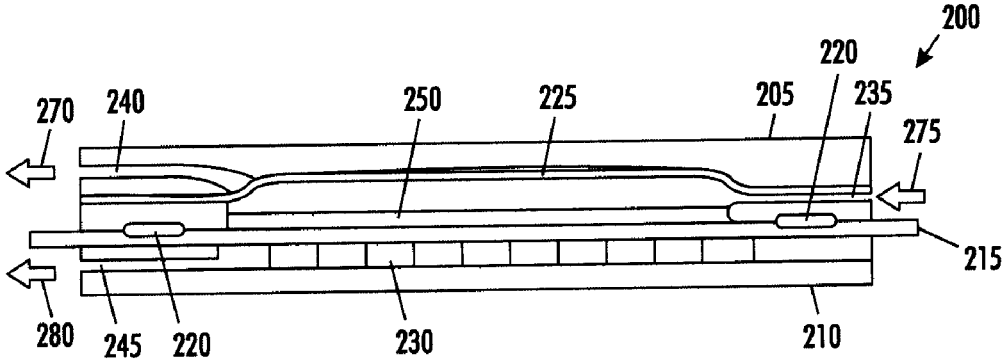

FIG. 1 is a plan view of a known horizontal filter press 100. The horizontal filter press 100 includes a press stand having a fixed base plate 1. Guide carrier beams 2 are attached to opposite inclined sides of the base plate 1 and a filter stand beam 3 is attached to the elevated side of the base plate 1. The beams 2 and 3 are combined into a common transverse yoke 4 at the upper end of the press stand. A hydraulic closing cylinder 5 is mounted to the upper end of the transverse yoke 4. A piston rod (not shown) of the closing cylinder 5 is coupled with a head plate 6, the head plate 6 being displaceable parallel to the length of the horizontal filter press 100.

A series of filter plates 7, which form a filter plate stack, are situated between the base plate 1 and the head plate 6. A plurality of filter plates 7 and a plurality of frames 8 are arranged in an alternating sequence. The filter plates 7 and frames 8 are supported on the two parallel guide carriers 2 by lateral guide attachments 9 formed on the filter elements as sliding blocks 10. In FIG. 1, the filter plate stack is open, such that the filter plates 7 are spaced apart from one another.

Filter cloth deflecting rolls 11 and 12 are mounted on opposite sides of each filter plate 7. A filter cloth 13 is guided by the rolls 11 and 12 in a serpentine fashion through the horizontal filter press, such that the filter cloth 13 is threaded between the upper side and the lower side of each filter plate 7. In FIG. 1, arrow 20 illustrates the path of the filter cloth 13.

After passage through the filter plate stack, the filter cloth 13 is passed through a driving station 18 mounted in the base plate 1, and onto a tensioning device 17. From the tensioning device 17, the filter cloth is threaded through a regulating device 16, guide rolls 15 and a driving station 14. Thereafter, the filter cloth 13 again runs through the filter plate stack in a serpentine manner, as described above.

The filter plates 7 are connected by a suspension device including, for example, a side bar chain that is designed so that, when open, the space between filter plates 7 is large enough to allow the filter cake 19 to be ejected from the horizontal filter press 100.

In various exemplary embodiments, methods according to this invention can be performed using any suitable horizontal filter press. In various exemplary embodiments, horizontal filtration systems such as those sold under the name LAROX PRESSURE FILTER by Larox Corporation, Jessup, Md., and under the name BETHLEHEM TOWER FILTER by Bethlehem Corporation, Easton, Pa., may be employed in practicing methods according to the present invention.

FIGS. 2(*a*) to 2(*e*) are schematic cross-sections of filter plates used in a horizontal filter press, showing performance of an exemplary method according to the present invention. As shown in FIG. 2(*a*), the filter plate 200 includes an upper plate 205 and a lower plate 210. A filter cloth 215 is situated between the upper plate 205 and the lower plate 210. The filter cloth 215 may be provided so as to be threaded, in a serpentine fashion, through several adjacent filter plates 200. Any suitable filter cloth may be used in practicing methods according to the present invention. In various exemplary embodiments, a filter cloth having an air permeability of from about 0.01 to about 10 $ft^3/ft^2/min$ may be employed.

The upper plate 205 includes seals 220, which ensure that the upper plate 205 and lower plate 210 fit tightly together and securely hold the filter cloth 215 in place. In various exemplary embodiments, upper and lower plates may be elements in a stack of filter plates that are pressed together with a force of, for example, from about 435 to about 1,090 psi. The upper plate 205 further includes a moveable diaphragm 225, which can be displaced within a space formed between the upper plate 205 and the filter cloth 215, which is situated over the lower plate 210. The upper plate 205 includes an inflow duct 235, which allows various materials (e.g., slurries, washing liquids, air) to be pumped into a space between the diaphragm 225 and the filter cloth 215. The upper plate 205 also includes a diaphragm duct 240. The diaphragm duct 240 allows fluids to be pumped into a space between a lower surface of the upper plate 205 and the diaphragm 225.

The lower plate 210 includes a grid 230 and an outflow duct 245. The grid 230 forms a surface over which the filter cloth 215 is provided. The grid 230 provides an area to which fluids that pass through the filter cloth 215 can go. The outflow duct 245 allows fluids that have accumulated in the grid 230 to pass out of the filter plate 200.

FIG. 2(*a*) also includes two arrows 255 and 260. The arrows 255 and 260 illustrate the path of materials that flow into and out of the filter plate 200 during performance of an exemplary embodiment of a method according to the present invention. The slurry-in arrow 255 shows that a slurry containing toner particles in dispersion is pumped into the filter plate 200 via the inflow duct 235. In various exemplary embodiments, slurry is pumped into a filter plate at a pressure of, for example, from about 1 to about 185 psi. The slurry enters the area situated below the diaphragm 225 and above the filter cloth 215. The pressure with which the slurry is pumped into the filter plate 200 causes some of the liquid portion of the slurry to pass through the filter cloth 215 into the grid 230 and out of the filter plate 200 via the outflow duct 245. This passage of filtrate from the filter plate 200 is shown by the filtrate-out arrow 260.

In FIG. 2(*b*), the arrows 260 and 265 illustrate the path of materials that flow into and out of the filter plate 200 during continuing performance of an exemplary embodiment of a method according to the present invention. The water-in arrow 265 shows that water (any suitable liquid may be used) is pumped into the filter plate 200 via the diaphragm duct 240. The water enters the area situated below a lower surface of the upper plate 205 and above the diaphragm 225. As water is pumped into the filter plate 200 through the diaphragm duct 240 the diaphragm 225 is displaced to reduce the volume of the region occupied by the slurry. This reduction in volume, and thus increase in pressure, causes much of the liquid portion of the slurry to pass through the filter cloth 215 into the grid 230 and out of the filter plate 200 via the outflow duct 245. In various exemplary embodiments, the diaphragm presses down on the slurry at a pressure of, for example, from about 10 to about 235 psi. The passage of filtrate from the filter plate 200 is shown by the filtrate-out arrow 260. This removal of liquid from the slurry causes a toner cake 250 to form between the diaphragm 225 and the filter cloth 215. By controlling the pressures and durations at which materials are introduced to a horizontal filter press, and the pressure with which those materials are pressed, the final moisture content, consistency, resistivity and porosity of a resulting toner cake can be tightly controlled.

In FIG. 2(*c*), the arrows 255, 260 and 270 illustrate the path of materials that flow into and out of the filter plate 200 during continuing performance of an exemplary embodiment of a method according to the present invention. The water-out arrow 270 shows that water situated below a lower surface of the upper plate 205 and above the diaphragm 225, is allowed to flow out of the filter plate 200 via the diaphragm duct 240. As water flows out of the filter plate 200 through the diaphragm duct 240, the diaphragm 225 moves to its original position increasing the volume of the region between the diaphragm 225 and the filter cloth 215. After the diaphragm 225 returns to its original position, a wash fluid is pumped into the area situated below the diaphragm 225 and above the filter cloth 215. This pumping of a wash fluid is shown by the wash-in arrow 255. As wash fluid is pumped into the filter plate 200 through the inflow duct 235, the toner cake 250 is re-dispersed in the wash fluid, reforming a slurry. The pressure with which the wash fluid is pumped into the filter plate 200 causes some of the liquid portion of the slurry to pass through the filter cloth 215 into the grid 230 and out of the filter plate 200 via the outflow duct 245. This passage of filtrate from the filter plate 200 is shown by the filtrate-out arrow 260.

In various exemplary embodiments, wash fluid is pumped into the filter plate to wash de-watered toner particles. Washing can be used to remove undesired impurities such as, for example, surfactants and residual sodium, present on the surface of toner particles as a result of the processes by which the toner particles were synthesized.

In FIG. 2(*d*), the arrows 260 and 265 illustrate the path of materials that flow into and out of the filter plate 200 during continuing performance of an exemplary embodiment of a method according to the present invention. The water-in arrow 265 shows that water is pumped into the filter plate 200 via the diaphragm duct 240. The water enters the area situated below a lower surface of the upper plate 205 and above the diaphragm 225. As water is pumped into the filter plate 200 through the diaphragm duct 240 the diaphragm 225 is displaced to reduce the volume of the region occupied by the reformed slurry. This reduction in volume, and thus increase in pressure, causes much of the liquid portion of the reformed slurry to pass through the filter cloth 215 into the grid 230 and out of the filter plate 200 via the outflow duct 245. The passage of filtrate from the filter plate 200 is shown by the filtrate-out arrow 260. This removal of liquid from the slurry causes a toner cake 250 to reform between the diaphragm 225 and the filter cloth 215. In various exemplary embodiments, the liquid removed from the slurry may be collected for evaluation. As with de-watering, when washing, the final moisture content, consistency, resistivity and porosity of a resulting toner cake can be tightly controlled by controlling the pressures and durations at which materials are introduced to a horizontal filter press, and the pressure with which those materials are pressed.

In FIG. 2(*e*), the arrows 270, 275 and 280 illustrate the path of materials that flow into and out of the filter plate 200 during continuing performance of an exemplary embodiment of a method according to the present invention. The water-out arrow 270 shows that water situated below a lower surface of the upper plate 205 and above the diaphragm 225, is allowed to flow out of the filter plate 200 via the diaphragm duct 240. As water flows out of the filter plate 200 through the diaphragm duct 240, the diaphragm 225 moves to its original position increasing the volume of the region between the diaphragm 225 and the filter cloth 215. After the diaphragm 225 returns to its original position, air is pumped into the area situated below the diaphragm 225 and above the filter cloth 215. This pumping of air is shown by the air-in arrow 275. As air is pumped into the filter plate 200 through the inflow duct 235, the toner cake is dried. The pressure with which the air is pumped into the filter plate 200 causes a portion of the air to pass through the toner cake 250 and filter cloth 215 into the grid 230 and out of the filter plate 200 via the outflow duct 245. In various exemplary embodiments, air may be pumped into a filter plate at a pressure of, for example, from about 5 to about 150 psi. This passage of air from the filter plate 200 is shown by the air-out arrow 280.

Figure 3:
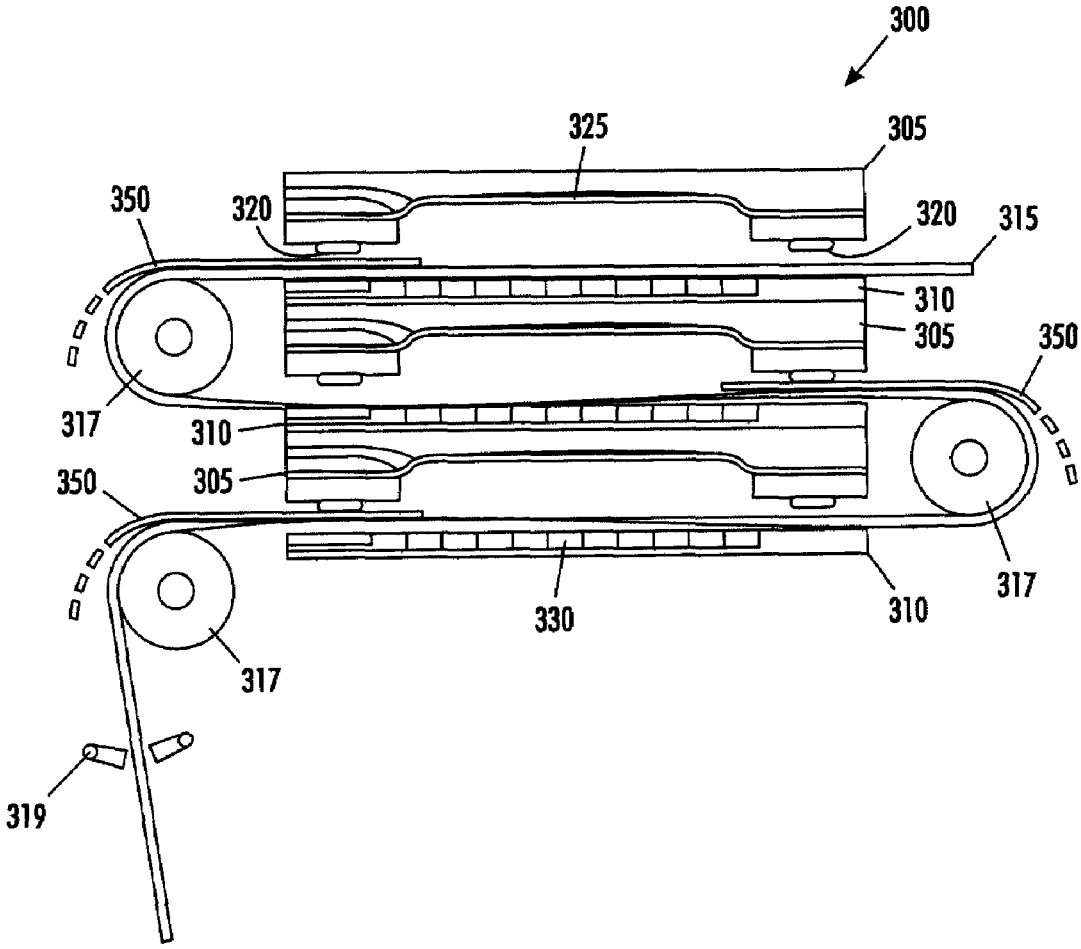
FIG. 3 is a schematic cross section of several stacked filter plates used in a horizontal filter press, showing performance of an exemplary method according to the present invention.

FIG. 3 is a schematic cross section of several stacked filter plates 300 used in a horizontal filter press, showing continuing performance of an exemplary method according to the present invention. As shown in FIG. 3, each filter plate 300 includes an upper plate 305 and a lower plate 310. The lower plate 310 of one filter plates 300 may form a continuous body with the upper plate 305 of a second filter plate 300 situated beneath the first filter plate 300. The lower plate 310 includes a arid 330. A filter cloth 315 is wound in a serpentine manner between respective upper plates 305 and lower plates 310. The serpentine winding of the filter cloth 315 is accomplished by winding around rollers 317 situated in a staggered configuration adjacent to the stacked filter plates 300.

In FIG. 3, the filter plates 300 are in an opened configuration. That is, diaphragms 325 are in their respective un-displaced positions, and the upper plates 305 and the lower plates 310 are separated such that seals 320 situated on a lower surface of the upper plates 305 are lifted off the filter cloth 315 so that the filter cloth 315 can wind freely through the stacked filter plates 300. After formation of a toner cake 350 and placement of the stacked filter plates 300 in an opened configuration, the filter cloth 315 is moved through the filter plates 300. As the filter cloth 315 passes out of the stacked filter plates 300 and over the rollers 317, the toner cake 350 is caused to separate from the filter cloth 315 for collection. In various exemplary embodiments, a horizontal filter press may be further provided with scrapers for separating toner cake from filter cloth. After the filter cloth 315 winds through the stacked filter plates 300 and the rollers 317, it passes through nozzles 319. The nozzles 319 spray a washing fluid onto the filter cloth 315, removing any residuum of the toner cake 350 on the filter cloth 315. By employing nozzles 319 to remove residual toner from the filter cloth 315, blinding, which is often problematic in centrifuge or vertical pressure filtration de-watering and washing processes, can be prevented and/or avoided.

Figure 4:
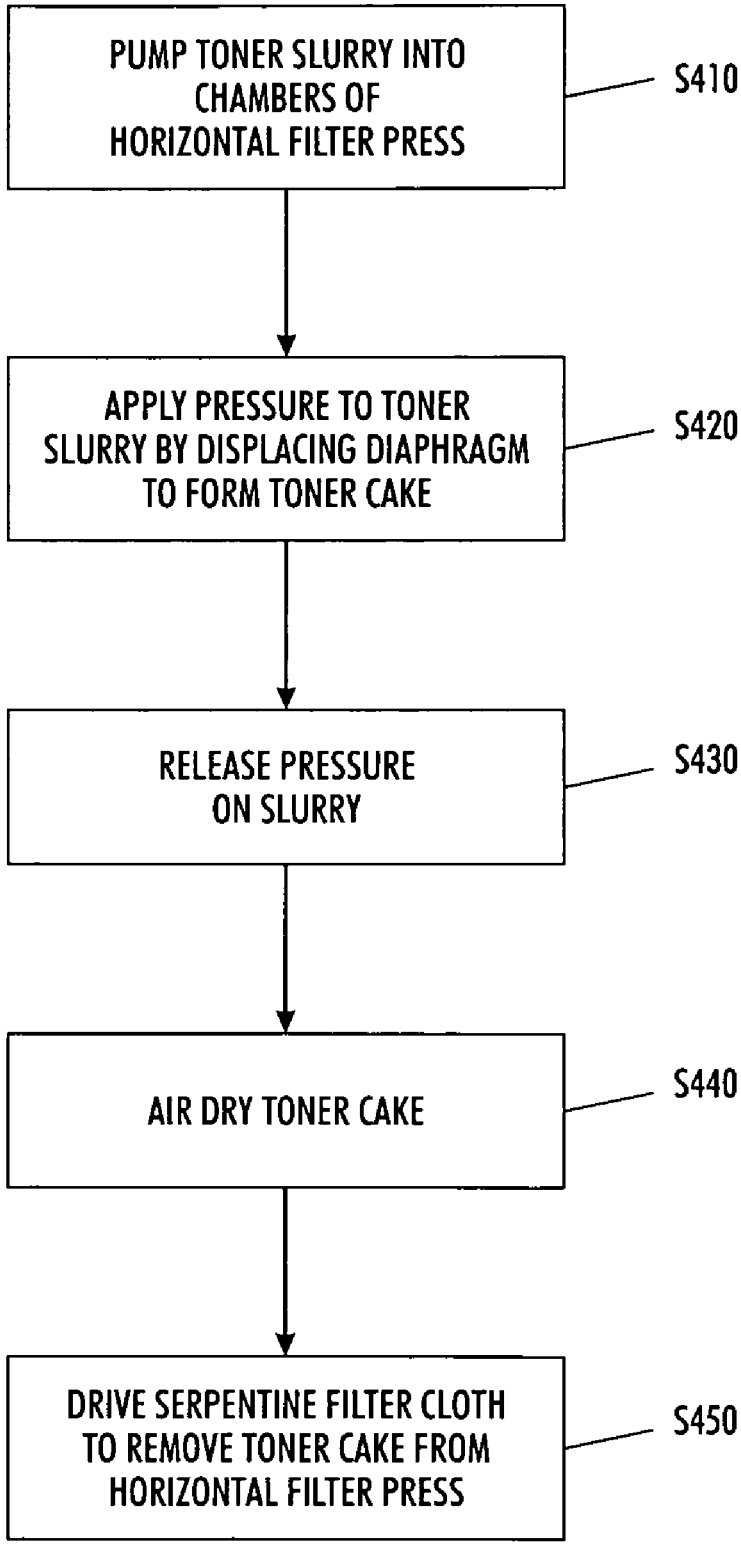
FIG. 4 is a flow chart showing an exemplary method according to the present invention.

FIG. 4 is a flow chart showing an exemplary method according to the present invention. In step S410, toner slurry is pumped into a horizontal filter press such as, for example, a horizontal filter press including the features shown in FIGS. 1-3 and described above. In various exemplary embodiments, the toner slurry can include toner particles synthesized by an emulsion-aggregation process. In some such embodiments, the toner slurry can include styrene-acrylate and/or polyester toner particles. In various exemplary embodiments, toner slurry is pumped into the horizontal filtration press at a pressure of from about 1 to about 185 psi. In some such embodiments, toner slurry is pumped into the horizontal filtration press at a pressure of from about 15 to about 60 psi. In step S420, pressure is applied to the toner slurry by displacing diaphragms in filter plates of the horizontal filter press, causing liquid in the toner slurry to be driven through a filter cloth in the horizontal filter press and out of the press. The application of pressure in step S420 results in formation of a toner cake. In various exemplary embodiments, the applied pressure is from about 10 to about 235 psi. In some such embodiments, the applied pressure is from about 125 to about 200 psi. In various exemplary embodiments, sufficient pressure is applied to provide a toner cake having a moisture content of from about 18 to about 41 percent. In step S430, the diaphragm is released from its displaced position. In step S440, air is pumped into the filter plates of the horizontal filter press to air dry the toner cake. In various exemplary embodiments, the air is introduced at a pressure of from about 5 to about 150 psi. In some such embodiments, air is introduced at a pressure of from about 50 to about 125 psi. In step S450, the filter cloth of the horizontal filter press is driven in a serpentine fashion through the horizontal filter press to remove the toner cake from the horizontal filter press.

Figure 5:
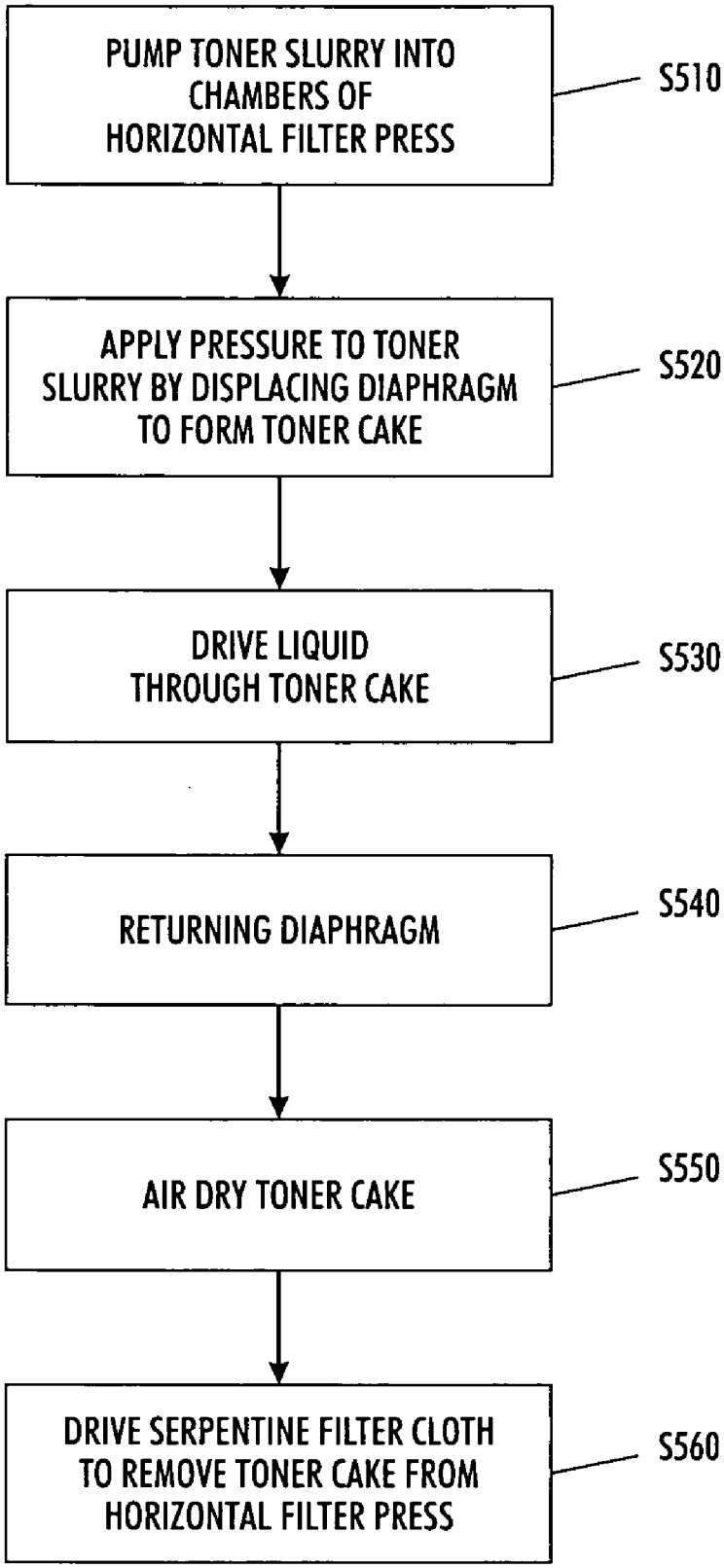
FIG. 5 is a flow chart showing an exemplary method according to the present invention.

FIG. 5 is a flow chart showing an exemplary method according to the present invention. In step S510, toner slurry is pumped into a horizontal filter press such as, for example, a horizontal filter press including the features shown in FIGS. 1-3 and described above. In various exemplary embodiments, the toner slurry can include toner particles synthesized by an emulsion-aggregation process. In some such embodiments, the toner slurry can include styrene-acrylate and/or polyester toner particles. In various exemplary embodiments, toner slurry is pumped into the horizontal filtration press at a pressure of from about 1 to about 185 psi. In some such embodiments, toner slurry is pumped into the horizontal filtration press at a pressure of from about 15 to about 60 psi.

In step S520, pressure is applied to the toner slurry by displacing diaphragms in filter plates of the horizontal filter press, causing liquid in the toner slurry to be driven through a filter cloth in the horizontal filter press and out of the press. The application of pressure in step S520 results in formation of a toner cake. In various exemplary embodiments, the applied pressure is from about 10 to about 235 psi. In some such embodiments, the applied pressure is from about 125 to about 200 psi. In various exemplary embodiments, sufficient pressure is applied to provide a toner cake having a moisture content of from about 18 to about 41 percent.

In step S530, a washing liquid is driven through the toner cake, which remains situated, under pressure, between the diaphragm and the filter cloth. The washing liquid moves through the toner cake, removing undesired impurities, and out of the filter press via the filter cloth. In various exemplary embodiments, the washing liquid is water. In various exemplary embodiments, the washing liquid is pumped into the horizontal filter press at a pressure of from about 1 to about 185 psi. In some such embodiments, the washing liquid is pumped into the horizontal filter press at a pressure of from about 15 to about 45 psi. In various exemplary embodiments, washing liquid is introduced into the filter plate for a period of from about 3 to about 90 minutes. In some such embodiments, washing liquid is introduced into the filter plate for a period of from about 10 minutes to about 60 minutes. In various exemplary embodiments, step S530 can be repeated. In some such embodiments, step S530 is performed two, three, four, five or six times. In various exemplary embodiments, after step S530, the toner cake has a moisture content of from about 18 to about 41 percent.

In step S530, the diaphragm is in a displaced position. In step S540, the diaphragm is released from its displaced position, and returned to its original, non-displaced position. In step S550, air is pumped into the filter plates of the horizontal filter press to air dry the toner cake. In various exemplary embodiments, the air is introduced at a pressure of from about 5 to about 150 psi. In some such embodiments, air is introduced at a pressure of from about 50 to about 125 psi. In step S560, the filter cloth of the horizontal filter press is driven in a serpentine fashion through the horizontal filter press to remove the toner cake from the horizontal filter press.

Figure 6:
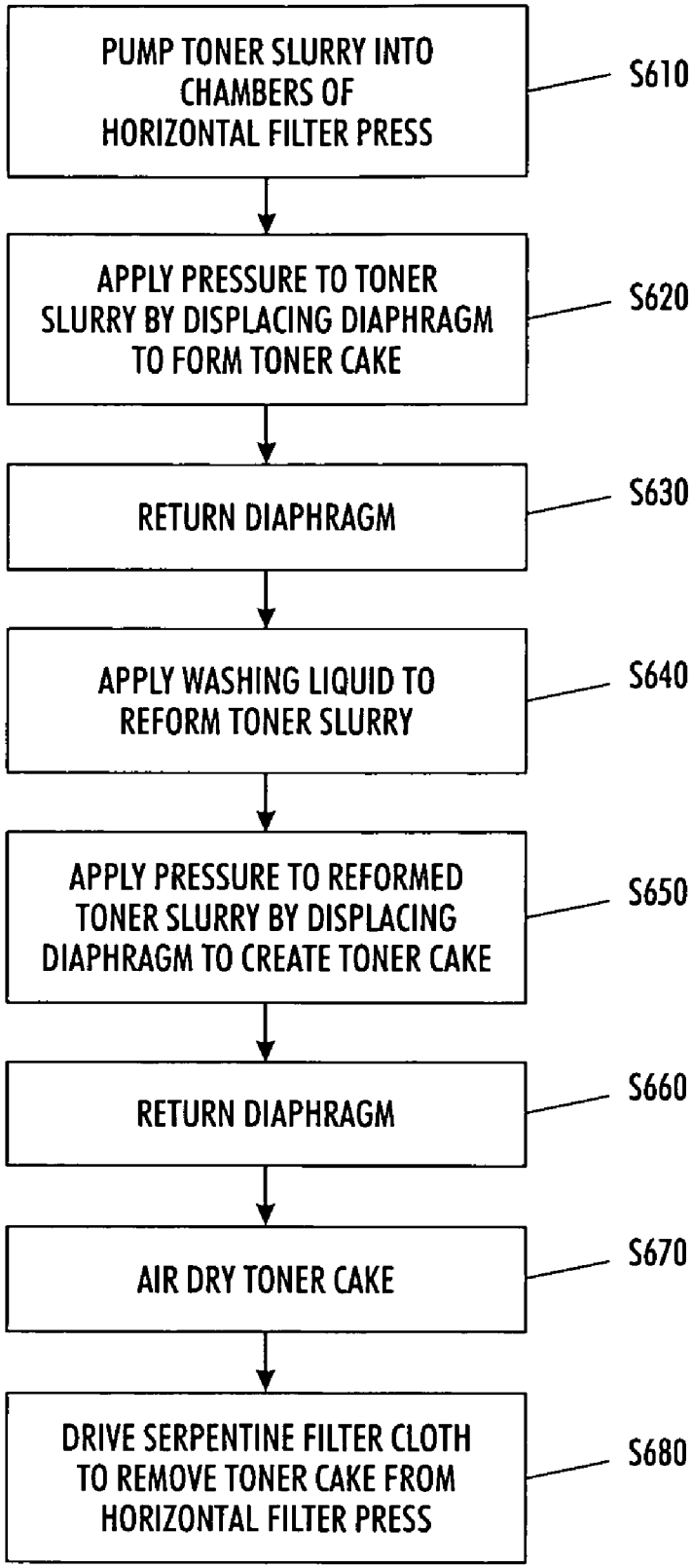
FIG. 6 is a flow chart showing an exemplary method according to the present invention.

FIG. 6 is a flow chart showing an exemplary method according to the present invention. In step S610, toner slurry is pumped into a horizontal filter press such as, for example, a horizontal filter press including the features shown in FIGS. 1-3 and described above. In various exemplary embodiments, the toner slurry can include toner particles synthesized by an emulsion-aggregation process. In some such embodiments, the toner slurry can include styrene-acrylate and/or polyester toner particles. In various exemplary embodiments, toner slurry is pumped into the horizontal filtration press at a pressure of from about 1 to about 185 psi. In some such embodiments, toner slurry is pumped into the horizontal filtration press at a pressure of from about 15 to about 60 psi.

In step S620, pressure is applied to the toner slurry by displacing diaphragms in filter plates of the horizontal filter press, causing liquid in the toner slurry to be driven through a filter cloth in the horizontal filter press and out of the press. The application of pressure in step S620 results in formation of a toner cake. In various exemplary embodiments, the applied pressure is from about 10 to about 235 psi. In some such embodiments, the applied pressure is from about 125 to about 200 psi. In various exemplary embodiments, sufficient pressure is applied to provide a toner cake having a moisture content of from about 18 to about 41 percent. In step S620, the diaphragm is in a displaced position. In step S630, the diaphragm is released from its displaced position, and returned to its original, non-displaced position.

In step S640, a washing liquid is pumped into the horizontal filter press, causing the toner cake to return to slurry form. In various exemplary embodiments, the washing liquid is water. In various exemplary embodiments, the washing liquid is pumped into the horizontal filter press at a pressure of from about 1 to about 185 psi. In some such embodiments, the washing liquid is pumped into the horizontal filter press at a pressure of from about 15 to about 45 psi. In various exemplary embodiments, washing liquid is introduced into the filter plate for a period of from about 3 to about 90 minutes. In some such embodiments, washing liquid is introduced into the filter plate for a period of from about 10 minutes to about 60 minutes. In various exemplary embodiments, step S640 can be repeated. In some such embodiments, step S640 is performed two, three, four, five or six times.

In step S650, pressure is applied to the new toner slurry by displacing diaphragms in filter plates of the horizontal filter press, causing liquid in the toner slurry to be driven through a filter cloth in the horizontal filter press and out of the press. The application of pressure in step S650 results in reformation of a toner cake. In various exemplary embodiments, the applied pressure is from about 10 to about 235 psi. In some such embodiments, the applied pressure is from about 125 to about 200 psi. In various exemplary embodiments, sufficient pressure is applied to provide a toner cake having a moisture content of from about 18 to about 41 percent. In step S650, the diaphragm is in a displaced position. In step S660, the diaphragm is released from its displaced position and returned to its original, non-displaced position.

In step S670, air is pumped into the filter plates of the horizontal filter press to air dry the toner cake. In various exemplary embodiments, the air is introduced at a pressure of from about 5 to about 150 psi. In some such embodiments, air is introduced at a pressure of from about 50 to about 125 psi. In step S680, the filter cloth of the horizontal filter press is driven in a serpentine fashion through the horizontal filter press to remove the toner cake from the horizontal filter press.

Figure 7:
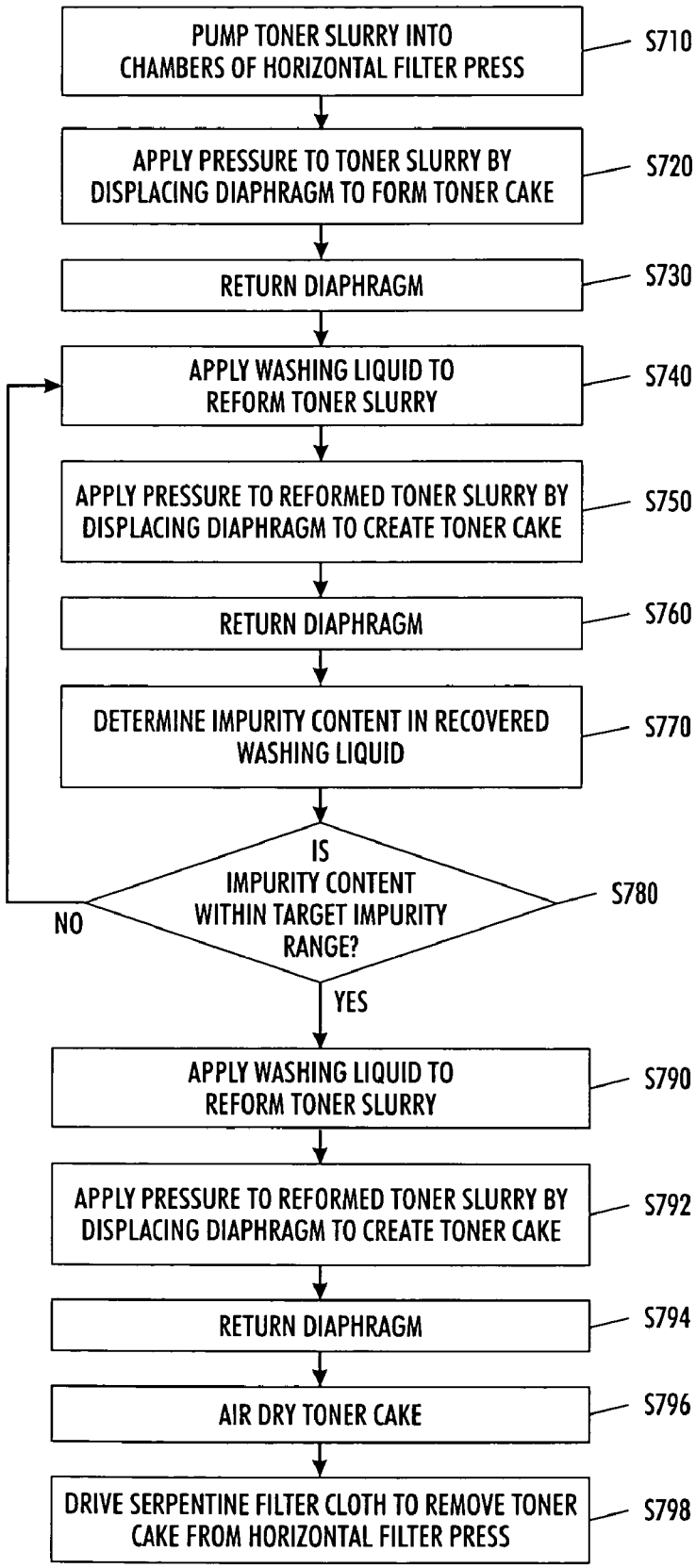
FIG. 7 is a flow chart showing an exemplary method according to the present invention.

FIG. 7 is a flow chart showing an exemplary method according to the present invention. In step S710, toner slurry is pumped into a horizontal filter press such as, for example, a horizontal filter press including the features shown in FIGS. 1-3 and described above. In various exemplary embodiments, the toner slurry includes water and toner at a ratio of, for example, about 6:1.

In step S720, pressure is applied to the toner slurry by displacing diaphragms in filter plates of the horizontal filter press, causing liquid in the toner slurry to be driven through a filter cloth in the horizontal filter press and out of the press. The application of pressure in step S720 results in formation of a toner cake. In various exemplary embodiments, pressure is applied to toner slurry with a diaphragm at a pressure for a sufficient time to form a toner cake having a moisture content of from about 35 to about 70 percent. In some such embodiments, pressure is applied to the toner slurry with a diaphragm at a pressure for a sufficient time to form a toner cake having a moisture content of about 60 percent.

In step S720, the diaphragm is in a displaced position. In step S730, the diaphragm is released from its displaced position, and returned to its original, non-displaced position. In step S740, a washing liquid is pumped into the horizontal filter press, causing the toner cake to return to slurry form. In various exemplary embodiments, the washing liquid is water. In various exemplary embodiments, an amount of washing liquid is pumped into the horizontal filter press that is sufficient to form a slurry having a ratio of washing liquid to toner of about 3:1. In step S750, pressure is applied to the new toner slurry by displacing diaphragms in filter plates of the horizontal filter press, causing liquid in the toner slurry to be driven through a filter cloth in the horizontal filter press and out of the press. The application of pressure in step S750 results in reformation of a toner cake. In various exemplary embodiments, pressure is applied to the toner slurry with a diaphragm at a pressure for a sufficient time to form a toner cake having a moisture content of from about 35 to about 70 percent. In some such embodiments, pressure is applied to the toner slurry with a diaphragm at a pressure for a sufficient time to form a toner cake having a moisture content of about 60 percent. In step S750, the diaphragm is in a displaced position. In step S760, the diaphragm is released from its displaced position, and returned to its original, non-displaced position.

In step S770, the washing liquid that is driven from the slurry in step S750 is tested to determine the impurity content of the washing liquid. Impurity content can be tested by any suitable method. In various exemplary embodiments, the washing liquid is tested to determine its conductivity. As shown in step S780, if the recovered washing liquid has an impurity content that is outside of a target range, operation returns to step S740, and a slurry is reformed from the toner cake. In various exemplary embodiments, if operation returns to step S740, the slurry is reformed using the washing liquid recovered and tested in step S770. If the recovered washing liquid has an impurity content that falls within a target range, operation proceeds to step S790.

The target range can be any range that that is indicative of an impurity content that will provide desired toner properties. In various exemplary embodiments, the target range can be determined with respect to one or more previous measurements of impurity content. For example, the target range can be an impurity content measurement that is similar to or about the same as a previous impurity content measurement. Obtaining the same or similar impurity content measurements in sequential tests can indicate that an equilibrium has been obtained between the amount of impurities in a toner cake and the amount of impurities that have been transferred to a washing liquid. In various exemplary embodiments, the target range is reached after a tested parameter trends toward a value of that parameter in the original washing liquid. For example, it may be desirable to test for one or more of pH, conductivity and surface tension of a washing liquid. The target range can be a range of values for pH, conductivity and/or surface tension that approximates the values for pH, conductivity and/or surface tension of the washing liquid before washing.

In step S790, a washing liquid is pumped into the horizontal filter press, causing the toner cake to return to slurry form. In various exemplary embodiments, the washing liquid is water. In still further exemplary embodiments, the washing liquid is a surface treatment such as, for example, an acid. In various exemplary embodiments, an amount of washing liquid is pumped into the horizontal filter press that is sufficient to form a slurry having a ratio of washing liquid to toner of about 6:1. In step S792, pressure is applied to the new toner slurry by displacing diaphragms in filter plates of the horizontal filter press, causing liquid in the toner slurry to be driven through a filter cloth in the horizontal filter press and out of the press. The application of pressure in step S792 results in reformation of a toner cake. In various exemplary embodiments, pressure is applied to the toner slurry with a diaphragm at a pressure for a sufficient time to form a toner cake having a moisture content of from about 18 to about 41 percent. In step S792, the diaphragm is in a displaced position. In step S794, the diaphragm is released from its displaced position, and returned to its original, non-displaced position. In various exemplary embodiments, if the washing liquid used in step S790 is a surface treatment, steps S790-S794 can be repeated, for example, using water as a washing liquid.

In step S796, air is pumped into the filter plates of the horizontal filter press to air dry the toner cake. In step S798, the filter cloth of the horizontal filter press is driven in a serpentine fashion through the horizontal filter press to remove the toner cake from the horizontal filter press.

This invention is illustrated by the following examples, which are merely for the purpose of illustration.

EXAMPLES

Several Examples and Comparative Examples were prepared to demonstrate the advantages of the toner washing and dewatering techniques described herein relative to known toner washing and dewatering techniques. In the Examples and Comparative Examples, black, cyan, magenta and yellow toners suitable for actual use were prepared. While the same materials were used to form the respective colored toners, the toners of the Examples were washed and dewatered by a method such as described above and shown in FIG. 4. The toners of the Comparative Examples were washed and dewatered by a conventional reslurry-and-centrifuge washing and dewatering technique. The washing liquid consumption and properties of the resulting toners are shown in Table 1 (Examples) and Table 2 (Comparative Examples) below.

TABLE 1

| | Examples | | | |
|---|---|---|---|---|
| | EA Toner Sample | | | |
| | Black | Cyan | Magenta | Yellow |
| Water Consumption (Washing Water to Toner Weight Ratio) | 22 | 22 | 23 | 22 |
| Residual Surfactant (ppm) | 1138 | 1058 | 2421 | 1373 |
| Residual Sodium (ppm) | 71 | 92 | 107 | 106 |
| Particle Charging q/d (A-zone, mm) | 905 | 12.2 | 11.0 | 12.0 |
| Particle Charging q/d (C-zone, mm) | 14.9 | 17.5 | 15.2 | 19.1 |
| Particle charging A/C ratio | 0.64 | 0.70 | 0.72 | 0.63 |
| Particle Silica Content (wt %) | — | 0.92 | 0.88 | 0.46 |

TABLE 2

| | Comparative Examples | | | |
|---|---|---|---|---|
| | EA Toner Sample | | | |
| | Black | Cyan | Magenta | Yellow |
| Water Consumption (Washing Water to Toner Weight Ratio) | 30 | 30 | 30 | 30 |
| Residual Surfactant (ppm) | 1337 | 2217 | 4830 | 2700 |
| Residual Sodium (ppm) | 83 | 130 | 190 | 145 |

TABLE 2-continued

| | Comparative Examples | | | |
|---|---|---|---|---|
| | EA Toner Sample | | | |
| | Black | Cyan | Magenta | Yellow |
| Particle Charging q/d (A-zone, mm) | 8.9 | 11.8 | 9.9 | 10.1 |
| Particle Charging q/d (C-zone, mm) | 15.2 | 22.0 | 15.3 | 20.2 |
| Particle charging A/C ratio | 0.59 | 0.54 | 0.65 | 0.50 |
| Particle Silica Content (wt %) | — | 0.62 | 0.57 | 0.18 |

As shown in the Tables above, de-watering and washing toner particles according to the present invention allows production of toner particles with: 50% lower surfactant levels than are possible with conventional methods; excellent humidity resistance properties (A/C ratios of 0.63 to 0.72 in comparison with A/C ratios of 0.50 to 0.65 with conventional methods); 150 to 250 percent higher silica retention than is possible with conventional methods; and 25 percent lower sodium levels than are possible by conventional methods.

Moreover, methods for de-watering and washing toner particles according to the present invention allow for a 33 percent reduction in washing cycle time. The reduction in washing cycle time reduces toner particle erosion and enhances the ability of the obtained toner particles to retain later added additives. In addition, methods for de-watering and washing toner particles according to the present invention allow for at least a 23 to 27 percent reduction in water use relative to conventional methods.

While this invention has been described in conjunction with the exemplary embodiments and examples outlined above, various alternatives, modifications, variations, improvements and/or substantial equivalents, whether known or that are or may be presently unforeseen, may become apparent to those having at least ordinary skill in the art. Accordingly, the exemplary embodiments of the invention, as set forth above, are intended to be illustrative, not limiting. Various changes may be made without departing from the spirit and scope of the invention. Therefore, the invention is intended to embrace all known or later developed alternatives, modifications, variations, improvements and/or substantial equivalents.

What is claimed is:

1. A method for washing and de-watering a toner, comprising:

(a) pumping an initial toner slurry into a filter plate of a horizontal filter press;

(b) applying pressure to the initial toner slurry with a diaphragm to drive an initial liquid through a filter cloth and forming an initial toner cake;

(c) releasing pressure from the initial toner cake;

(d) pumping a first washing liquid into the filter plate to form an intermediate toner slurry;

(e) applying pressure to the intermediate toner slurry with the diaphragm to drive a reforming liquid through the filter cloth, recovering the reforming liquid and forming an intermediate toner cake;

(f) releasing pressure from the intermediate toner cake;

(g) determining an impurity content of the reforming liquid;

(h) comparing the impurity content of the reforming liquid with a target impurity content range;

(i) if the impurity content of the reforming liquid is not within the target impurity content range, reforming the intermediate toner slurry, the reforming process comprised of:

(i)(1) pumping the reforming liquid into the filter plate to form a reformed intermediate toner slurry, (i)(2) applying pressure to the reformed intermediate toner slurry with the diaphragm to drive the reforming liquid through the filter cloth, recovering the reforming liquid and forming a reformed intermediate toner cake;

(i)(3) releasing pressure from the reformed intermediate toner cake;

(i)(4) determining an impurity content of the reforming liquid;

(i)(5) comparing the impurity content of the reforming liquid with a target impurity content range;

(i)(6) if the impurity content of the reforming liquid is not within the target impurity content range, repeating the reforming process of (i)(1)-(i)(6) with the reforming liquid until the impurity content of the reforming liquid is within the target impurity content range;

and wherein once the impurity content of the reforming liquid is within the target impurity content range, proceeding to (j)-(n);

(j) pumping a second washing liquid into the filter plate to form a final toner slurry;

(k) applying pressure to the final toner slurry with the diaphragm to drive a final liquid through the filter cloth and forming a final toner cake;

(l) releasing pressure from the final toner cake;

(m) pumping air into the filter plate to dry the final toner cake; and (n) driving the filter cloth through the horizontal filter press in a serpentine manner to remove the final toner cake.

2. The method of claim 1, wherein comparing the impurity content of the reforming liquid with the target impurity content range, comprises comparing the impurity content of the reforming liquid with a target impurity content range determined from a previously detected impurity content.

3. The method of claim 1, wherein the impurity content is determined by detecting the conductivity of the reforming liquid.

4. The method of claim 1, wherein the initial toner slurry includes water and toner at a ratio of 6:1.

5. The method of claim 1, wherein the intermediate toner slurry includes washing liquid and toner at a ratio of 3:1.

6. The method of claim 1, wherein the final toner slurry includes washing liquid and toner at a ratio of 6:1.

7. The method of claim 1, wherein pressure is applied to the initial toner slurry with the diaphragm at a pressure and for a time sufficient to form the initial toner cake with a moisture content of from about 35 to about 70 percent.

8. The method of claim 1, wherein pressure is applied to the intermediate toner slurry with the diaphragm at a pressure and for a time sufficient to form the intermediate toner cake with a moisture content of from about 35 to about 70 percent.

9. The method of claim 1, wherein pressure is applied to the final toner slurry with the diaphragm at a pressure and for a time sufficient to form the final toner cake with a moisture content of from about 18 to about 41 percent.

* * * * *